United States Patent [19]

Fujiwara et al.

[11] Patent Number: 4,472,114

[45] Date of Patent: Sep. 18, 1984

[54] ELECTRIC COMPRESSOR

[75] Inventors: Takayoshi Fujiwara, Kawasaki; Eiichi Aikawa, Yokohama, both of Japan

[73] Assignee: Tokyo Shibaura Denki Kabushiki Kaisha, Kawasaki, Japan

[21] Appl. No.: 452,401

[22] Filed: Dec. 22, 1982

[30] Foreign Application Priority Data

Jan. 21, 1982 [JP] Japan ..... 57-7925

[51] Int. Cl.[3] ..... F04B 35/00; F04B 39/02; F04B 39/10

[52] U.S. Cl. ..... 417/372; 417/500; 417/902

[58] Field of Search ..... 417/500, 368, 902, 492, 417/370, 372; 92/153; 123/450, 45 A

[56] References Cited

U.S. PATENT DOCUMENTS

| | | | |
|---|---|---|---|
| 3,285,192 | 11/1966 | Gutkowski | 417/500 |
| 4,091,638 | 5/1978 | Mitch | 417/902 X |

FOREIGN PATENT DOCUMENTS

| | | | |
|---|---|---|---|
| 919593 | 10/1954 | Fed. Rep. of Germany | 417/372 |
| 1936358 | 2/1971 | Fed. Rep. of Germany | 417/500 |
| 47-3307 | 9/1972 | Japan . | |
| 47-19806 | 11/1972 | Japan . | |
| 49-997313 | 9/1974 | Japan . | |
| 50-41524 | 11/1975 | Japan . | |
| 53-3452 | 1/1978 | Japan . | |
| 53-143016 | 12/1978 | Japan . | |
| 54-44212 | 7/1979 | Japan | 417/500 |
| 55-112883 | 9/1980 | Japan | 417/500 |
| 357502 | 3/1930 | United Kingdom . | |
| 438430 | 11/1935 | United Kingdom . | |
| 745578 | 2/1956 | United Kingdom . | |
| 1100024 | 1/1968 | United Kingdom . | |

*Primary Examiner*—Leonard E. Smith
*Assistant Examiner*—T. Olds
*Attorney, Agent, or Firm*—Cushman, Darby & Cushman

[57] ABSTRACT

An electric compressor including a cylinder having a cylinder chamber and inlet and outlet ports opening into the chamber, a piston capable of reciprocating in the chamber and having a first operative face with a first peripheral edge portion inclined at a given angle, a rotating member capable of rotating in the chamber and having an outer peripheral surface capable of opening and closing the inlet and outlet ports, and a second operative face with a second peripheral edge portion inclined at the given angle and capable of being in sliding contact with the first edge portion, the first and second operative face and the peripheral surface of the chamber defining a compression chamber, pushing device for pushing the piston toward the rotating member, and a motor for rotating the rotating member. The inlet and outlet ports are opened and closed and the piston is reciprocated so that gas is sucked into the compression chamber through the inlet port, compressed, and discharged through the outlet port.

12 Claims, 10 Drawing Figures

ELECTRIC COMPRESSOR

BACKGROUND OF THE INVENTION

This invention relates to an electric compressor.

Reciprocating electric compressors are generally provided with a cylinder which has a cylinder chamber and inlet and outlet ports opening into the cylinder chamber. The inlet and outlet ports are provided with a valve each. The valves open and close the inlet and outlet ports as the piston in the cylinder chamber reciprocates, thereby controlling the suction of gas into the cylinder chamber and the discharge of compressed gas from the cylinder chamber.

Since the valves are generally formed of valve plates, however, it is difficult for the valves exactly to follow the action of the piston, and a slight time lag is caused. This time lag will induce overcompression or overexpansion of the gas to be compressed and lower the volumetric efficiency. Moreover, the valves may break due to metal fatigue after prolonged use. The failure of the valves is the most frequent cause of troubles of compressors. Also, the valves may produce noise, and the use of the valves will increase the number of parts used and hence maufacturing cost.

Scroll- or screw-type compressors as a kind of rotary electric compressors use no valves, and are free from the aforementioned problems. The compressors of this type, however, are complicated in construction, and are low in manufacturing efficiency.

Also provided are reciprocating compressors without a suction valve, reciprocating compressors with neither a suction valve nor a delivery valve, and compressors without a delivery valve. These compressors, however, have the basic structure of a reciprocating or rotary compressor. Accordingly, the compressing conditions of the compressors may be adversely affected by the reduction or elimination of the valves. For example, a groove or a hole formed in the cylinder chamber to be used in place of the delivery valve will function like the top clearance of the cylinder chamber, thereby lowering the compression efficiency of the compressors.

Further, there is provided a compressor whose construction is quite different from those of the aforementioned conventional compressors. This compressor comprises a rotating disk in a casing and a non-rotating disk pushed toward the rotating disk by a spring. These two disks have corrugated contact surfaces to be in contact with each other. Gas to be compressed is sucked in between the contact surfaces for compression. In this compressor, the contact surfaces need be brought perfectly into contact with each other for secure compression of the gas. It is therefore very troublesome to work the contact surfaces. Moreover, this compressor includes many contact regions, and the contact surfaces are susceptible to abrasion. The compressor of this construction further has a plurality of inlet and outlet ports which penetrate the rotating and non-rotating disks and open into depressions in the contact surfaces. A check valve is provided in each of the ports. Thus, this compressor has a number of inlet and outlet ports, and requires additional working. Moreover, the use of the check valves in the ports adds to the number of parts. Furthermore, the amounts of compressed gas passing through the individual ports are liable to fluctuations, so that it is very hard to ensure efficient compression.

SUMMARY OF THE INVENTION

This invention is contrived in consideration of these circumstances, and is intended to provide an electric compressor requiring neither a suction valve nor a delivery valve, and which is simple in construction, with improved workability and compression efficiency.

According to one aspect of the invention, there is provided an electric compressor which comprises a cylinder having a cylindrical cylinder chamber and inlet and outlet ports opening into the cylinder chamber, a piston capable of reciprocating in the cylinder chamber and having a first operative face with a first peripheral edge portion inclined at a given angle to the operating direction of the piston, a rotating member capable of rotating in the cylinder chamber around the central axis of the cylinder chamber, and having an outer peripheral surface substantially equal in diameter to the cylinder chamber and capable of opening and closing the inlet and outlet ports, and a second operative face with a second peripheral edge portion inclined at the given angle to the operating direction of the piston and capable of being in sliding contact with the first peripheral edge portion, the second operative face, in conjunction with the first operative face and the peripheral surface of the cylinder chamber, defining a compression chamber capable of communicating with the inlet and outlet ports, pushing means for pushing the piston toward the rotating member to press the first peripheral edge portion against the second peripheral edge portion, and driving means for rotating the rotating member. As the rotating member is rotated, the inlet and outlet ports are opened and closed, and the piston is reciprocated so that gas is sucked into the compression chamber through the inlet port, compressed, and discharged through the outlet port.

According to this compressor, the inlet and outlet ports are opened and closed by the outer peripheral surface of the rotating member. Accordingly, there is no need for a suction valve or a delivery valve, so that the problems peculiar to valves can be solved. It is unnecessary to provide a hole or groove to replace the suction valve or delivery valve, so that the compressor of the invention has high compression efficiency. Moreover, the piston and the rotating member having the first and second operative faces are disposed in the cylinder chamber. Accordingly, the compressor of the invention is simpler in construction than the scroll-or screw-type compressors, and has substantially equal workability to that of the reciprocating compressors.

BRIEF DESCRIPTION OF THE DRAWINGS

FIGS. 1 to 5*d* show an electric compressor according to one embodiment of this invention, in which FIG. 1 is a longitudinal sectional view, FIGS. 2 and 3 are sectional views schematically showing different operating positions of the compressor as taken from the inlet port side, FIG. 4 is a perspective view showing a piston and a rotating member, and FIGS. 5*a* to 5*d* are sectional views schematically showing different operating positions of the compressor as taken from the outlet port side;

DETAILED DESCRIPTION OF THE PREFERRED EMBODIMENT

There will now be described in detail one embodiment of this invention with reference to the accompanying drawings.

Figure 1:
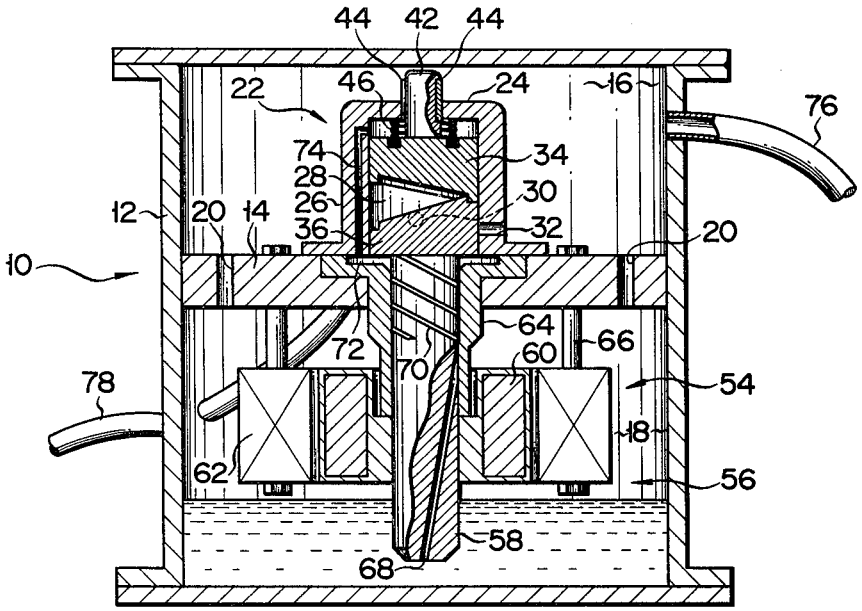

As shown in FIG. 1, an electric compressor 10 has a cylindrical casing 12. The interior of the casing 12 is vertically divided by a partition wall 14 therein. An accumulation chamber 16 and a motor chamber 18 are defined over and under the partition wall 14, respectively. The partition wall 14 is provided with a plurality of penetrating holes 20 whereby the accumulation chamber 16 and the motor chamber 18 are communicated with each other.

The electric compressor 10 also has a cylinder 22 which is attached to the partition wall 14 inside the accumulation chamber 16. The cylinder 22 includes a peripheral wall 26 blocked at the upper end by a top wall 24, and a cylindrical cylinder chamber 28 defined by the peripheral wall 26. The peripheral wall 26 has an inlet port 30 and an outlet port 32 which open into the cylinder chamber 28. The outlet port 32 also opens into the accumulation chamber 16.

Figure 2:
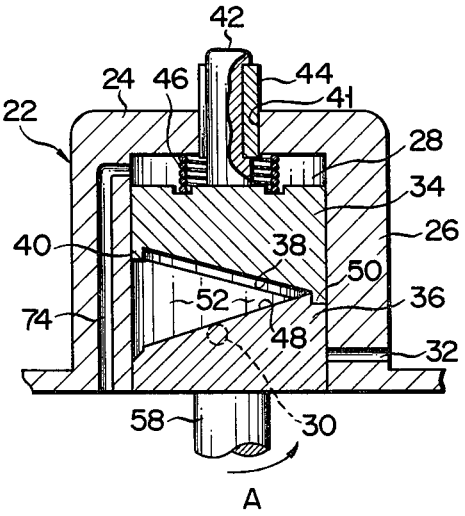
Figure 3:
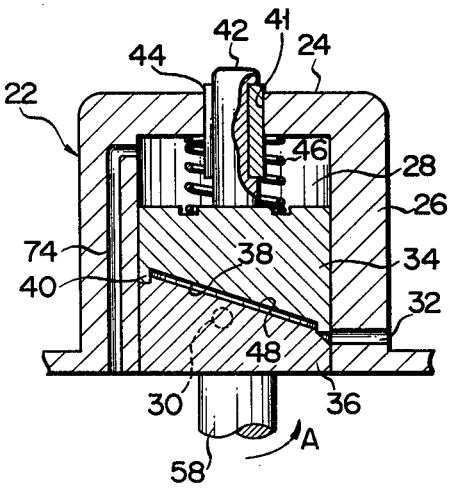
Figure 4:
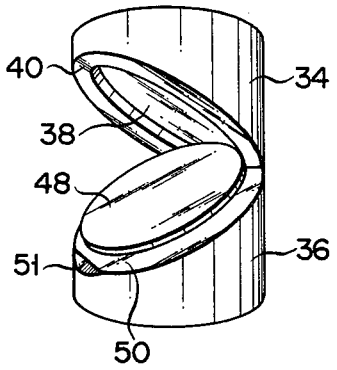

As seen from FIGS. 2 to 4, the compressor 10 comprises a piston 34 and a rotating member 36 which are disposed in the cylinder chamber 28. The piston 34 is in the form of a cylinder substantially equal in diameter to the cylinder chamber 28. The piston 34 can reciprocate in the cylinder chamber 28. The piston 34 has an upper end face opposed to the top wall 24, and a flat first operative face 38 inclined at a given angle to the operating direction of the piston 34 or to the axis of the cylinder chamber 28. The operative face 38 has a first peripheral edge portion 40 inclined at the given angle to the operating direction of the piston 34 protruding downward from the operative face 38. The piston 34 also has a supporting rod 42 extending upward from its upper end face to penetrate a through-hole 41 formed in the top wall 24 of the cylinder 22. The supporting rod 42 is fixedly fitted with a pair of keys 44 which engage the top wall 24. Thus, the piston 34 is guided in its reciprocation by the supporting rod 42, and is prevented from rotating by the keys 44. A compression spring 46 is interposed between the upper end face of the piston 34 and the top wall 24 of the cylinder 22 so that the piston 34 is pushed downward by the spring 46. The compression spring 46 constitutes a part of pushing means of this invention. The cylinder chamber 28 is communicated with the accumulation chamber 16 through the through-hole 41.

The rotating member 36 is also in the form of a cylinder substantially equal in diameter to the cylinder chamber 28, and can rotate around the axis of the cylinder chamber 28. The rotating member 36 has a lower end face located substantially flush with the upper surface of the partition wall 14 to close the lower end of the cylinder 22, and a flat second operative face 48 inclined at the given angle to the operating direction of the piston 34. The operative face 48 has a second peripheral edge portion 50 inclined at the given angle to the operating direction of the piston 34 and cut in the operative face 48. The second peripheral edge portion 50 is in contact with the first peripheral edge portion 40 of the piston 34, and can slide along the same. As seen from FIGS. 2 and 3, the first and second peripheral edge portions 40 and 50 are so formed that the sections of their faces taken along the axes of the piston 34 and the rotating member 36 are substantially horizontal. As seen from FIG. 4, moreover, the lowermost part of the second peripheral edge portion 50 is cut aslant to form a cut face 51. The second operative face 48, in conjunction with the first operative face 38 and the peripheral surface of the cylinder chamber 28, defines a compression chamber 52. The inlet and outlet ports 30 and 32 are located in a position where they can open into the compression chamber 52, and can be opened or closed by the outer peripheral surface of the rotating member 36.

As shown in FIG. 1, the electric compressor 10 is provided with driving means 54 for rotating the rotating member 36. The driving means 54 includes a motor 56 set in the motor chamber 18. The motor 56 has a rotating shaft 58, a rotor 60 fixed to the rotating shaft 58, and a stator 62 surrounding the rotor 60. The rotating shaft 58 is fixed at the upper end to the lower end face of the rotating member 36, and is supported by a bearing 64 attached to the partition wall 14. The rotating shaft 58 is coaxial with the cylinder chamber 28. The stator 62 is supported by a plurality of supporting arms 66. Lubricating oil is stored in the motor chamber 18. The rotating shaft 58 has a guide hole 68 to guide the lubricating oil. The lower and upper ends of the guide hole 68 open to the lower end and the outer peripheral surface of the rotating shaft 68, respectively. A guide groove 70 is formed on the outer peripheral surface of the upper portion of the rotating shaft 58, spirally extending to the upper end of the rotating shaft 58. The bearing 64 has a gain portion 72 connected to the guide groove 70. The cylinder 22 has a guide hole 74 in the peripheral wall 26 for guiding the lubricating oil. The lower and upper ends of the guide hole 74 open into the gain portion 72 and the cylinder chamber 28, respectively.

In FIG. 1, numeral 76 designates a discharge pipe opening into the accumulation chamber 16, and numeral 78 designates a suction pipe connected to the inlet port 30.

There will now be described the operation of the electric compressor 10 constructed in the aforementioned manner.

First, an outline of the operation will be given. When the motor 56 is started, the rotating member 36 is rotated. As a result, the piston 34 is reciprocated to change the capacity of the compression chamber 52 gradually. At the same time, the inlet and outlet ports 30 and 32 are opened and closed successively. Thus, gas is sucked into the compression chamber 52 through the inlet port 30, compressed in the compression chamber 52, and discharged through the outlet port 32.

Figure 5A:
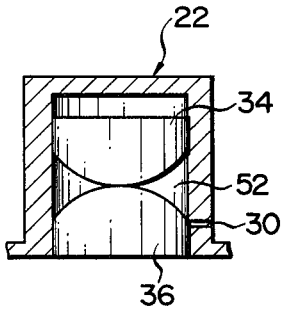
Figure 5B:
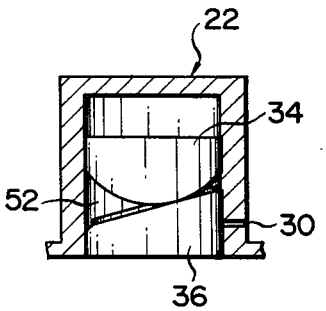
Figure 5C:
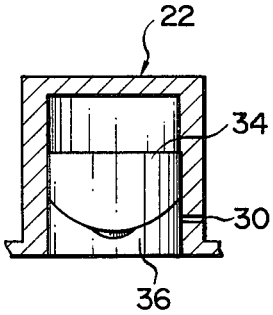
Figure 5D:
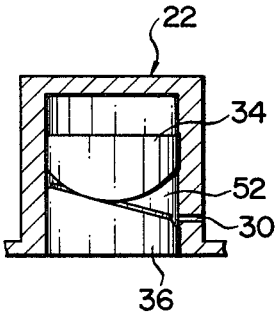

Referring now to FIGS. 2, 3 and 5*a* to 5*d*, the operation will be described in detail. FIGS. 5*a* to 5*d* are sectional views as taken from the outlet port side. FIGS. 5*a* and 5*c* correspond to the operating positions shown in FIGS. 2 and 3, respectively. FIGS. 2 and 5*a* show the position where the second operative face 48 is inclined directly opposite to the first operative face 38. In this position, the capacity of the compression chamber 52 is maximized. The inlet and outlet ports 30 and 32 are blocked by the outer peripheral surface of the rotating member 36. When the rotating member 36 is rotated in the direction indicated by arrow A, the piston 34 is lowered by the urging force of the compression spring 46, and the second peripheral edge portion 50 slides along the first peripheral edge portion 40. As the piston 34 is lowered, the capacity of the compression chamber 52 is reduced, so that the gas in the compression chamber 52 is compressed gradually. Then, the rotating member 36 is further rotated in the direction of arrow A to reach the position of FIG. 5c via the position of FIG. 5b. In the meantime, the piston 34 is further lowered, and the gas in the compression chamber 52 is further compressed as the inlet and outlet ports 30 and 32 are closed. In the position shown in FIGS. 3 and 5c, the first peripheral edge portion 40 is closely in contact with the second peripheral edge portion 50, and the first and second operative faces 38 and 48 are inclined in the same direction. In this position, the capacity of the compression chamber 52 is minimized, so that the gas in the compression chamber 52 is fully compressed. Since the outlet port 32 is opened at this time, the compressed gas in the compression chamber 52 is discharged into the accumulation chamber 16 (FIG. 1) through the outlet port 32. Then, when the rotating member 36 is further rotated in the direction of arrow A, the second peripheral edge portion 50 slides along the first peripheral edge portion 40 to force up the piston 34 against the urging force of the compression spring 46. As a result, the capacity of the compression chamber 52 is increased as shown in FIG. 5d, so that a negative pressure is produced in the compression chamber 52. Since the inlet port 30 is opened at this moment, gas is sucked into the compression chamber 52 through the suction pipe 78 (FIG. 1) and the inlet port 30 by the negative pressure in the compression chamber 52. Then, the rotating member 36 is further rotated to reach the position shown in FIGS. 2 and 5a. Meanwhile, the piston 34 is further pushed up to increase the capacity of the compression chamber 52 gradually. At this time, the inlet port 30 is opened, so that gas is gradually sucked into the compression chamber 52. In the position shown in FIGS. 2 and 5a, the capacity of the compression chamber 52 is maximized, and the compression chamber 52 is filled with the gas. At this moment, the inlet port 30 is closed.

The aforementioned cycle is repeated thereafter. As the gas compressed in the compression chamber 52 is discharged into the accumulation chamber 16, the pressure inside the accumulation chamber 16 and the motor chamber 18 increase gradually. The pressure inside the accumulation chamber 16 is applied to the upper end face of the piston 34 via the through-hole 41, whereby the piston is pushed downward, that is, toward the rotating member 36. Thus, the piston 34 is pushed by the compression spring 46 and the pressure inside the accumulation chamber 16 to compress the gas in the compression chamber 52. The accumulation chamber 16 constitutes a part of the pushing means of this invention.

When the motor 56 is rotated, the lubricating oil in the motor chamber 18 is led to the outer peripheral surface of the rotating shaft 58 through the guide hole 68. Then, the lubricating oil is led into the cylinder chamber 28 through the guide groove 70, the gain portion 72, and the guide hole 74. Thus, the interfaces between the rotating shaft 70 and the bearing 66 and between the piston 34 and the rotating member 36 and the cylinder 22 are lubricated by the lubricating oil. The used lubricating oil is returned to the motor chamber 18 through a discharge port (not shown) in the cylinder 22 and the penetrating hole 20.

Figure 6:
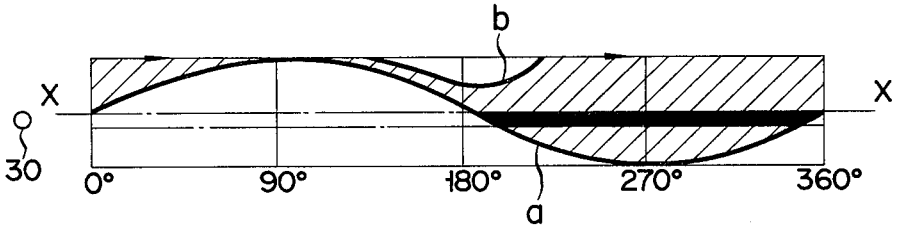
FIG. 6 is a diagram showing the state of communication of an inlet port.
Figure 7:
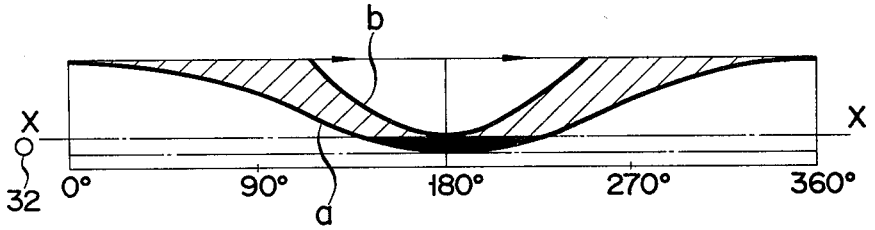
FIG. 7 is a diagram showing the state of communication of an outlet port.

Referring now to FIGS. 6 and 7, location or positioning of the inlet and outlet ports 30 and 32 will be explained.

The inlet port 30 is located below the center of the second operative face 48, and is opened and closed by the outer peripheral surface of the rotating member 36. FIG. 6 shows how the inlet port 30 is opened and closed. In FIG. 6, a curve a represents the height of the peripheral edge of the rotating member 36 obtained at the position of the inlet port 30. The height is measured with respect to the upper edge (line X—X) of the inlet port 30. Curve b represents the height of the peripheral edge of the piston 34 obtained at the position of the inlet port 30. If the position shown in FIG. 5a is given by "0°", the peripheral edge of the rotating member 36 is located at the upper edge of the inlet port 30 when the position is "0°". When the rotating member 36 is rotated through approximately 90°, the peripheral edge of the rotating member 36 is brought to its highest position. Thereafter, the peripheral edge describes the curve a as illustrated. Between the positions "0°" and "approximately 180°", the inlet port 30 is closed, and the gas in the compression chamber 52 is compressed. When the rotating member 36 is rotated through approximately 180°, the outlet port 32 is opened, and the gas in the compression chamber 52 is discharged. At this moment, the cut face 51 of the second peripheral edge portion 50 is opposed to the outlet port 32. The inlet port 30 is opened while the rotating member 36 rotates from the position "approximately 180°" to "360°". Namely, the gas is sucked into the compression chamber 52 during a period of time which corresponds to the black-belted region of FIG. 6. In this embodiment, the inlet port 30 is spaced at approximately 90° from the outlet port 32 along the circumferential direction of the cylinder chamber 28.

The outlet port 32 is located below the center of the second operative face 48, and is opened and closed by the outer peripheral surface of the rotating member 36. FIG. 7 shows how the outlet port 32 is opened and closed. In FIG. 7, curve a represents the height of the peripheral edge of the rotating member 36 obtained at the position of the outlet port 32, and line X—X represents the position of the upper edge of the outlet port 32. Curve b represents the height of the peripheral edge of the piston 34 obtained at the position of the outlet port 32. The outlet port 32 is located on the same level with the lowermost part of the peripheral edge of the piston 34, that is, at the position where the outlet port 32 can face the cut face 51. When the rotating member 36 is rotated through approximately 180°, the peripheral edge of the rotating member 36 is located at the lower edge of the outlet port 32, and the outlet port 32 is opened during a period of time which corresponds to the black-belted region of FIG. 7. In the meantime, the gas in the compression chamber 52 is discharged.

The electric compressor 10 of the aforementioned construction has the following advantages.

First, the inlet and outlet ports 30 and 32 are opened and closed by the outer peripheral surface of the rotating member 36. Accordingly, there is no need for a suction valve or a delivery valve. This leads to a reduction in the number of parts, as well as to solution of the problems peculiar to valves. It is unnecessary to provide a hole or groove to replace the suction valve or delivery valve, either, and the piston 34 can be fully pushed by the pushing means. Thus, the compressor 10 can enjoy high compression efficiency. In this compressor, moreover, the cylindrical piston 34 and the cylindrical rotating member 36 are disposed in the cylindrical cylinder chamber 28. Thus, the compressor is simple in construction, and can be worked with ease. The rotating shaft 58 of the motor 56 is coaxial with the cylinder chamber 28, so that the operating direction of the piston 34 and the rotating shaft of the rotating member 36 is in alignment with the rotating shaft 58 of the motor 56. Therefore, the rotating shaft 58 is not susceptible to the load attributed to the reciprocation of the piston 34 and the rotation of the rotating member 36. Thus, vibration and noise can be reduced substantially. The vertical sections of the faces of the first and second peripheral edge portions 40 and 50 taken along the axes of the piston 34 and the rotating member 36 are substantially horizontal so that the two edge portions 40 and 50 can be in surface contact. Accordingly, the peripheral edge portions are less susceptible to abrasion, and are fully durable.

Although an illustrative embodiment of this invention has been described in detail herein, it is to be understood that the invention is not limited to the embodiment. In the embodiment described above, the first and second peripheral edge portions 40 and 50 are projected and recessed from their corresponding operative faces 38 and 48, respectively. Alternatively, the faces of the peripheral edge portions may be flush with the operative faces. Although the operative faces 38 and 48 are described as being flat in the aforementioned embodiment, one of them may be formed convex to mate with the other which may be formed concave. In the embodiment described above, moreover, the second peripheral edge portion 50 has the cut face 51 whereby the communication of the outlet port 32 is controlled. The same effect may, however, be obtained without the use of the cut face. In the embodiment, the pushing means comprises the accumulating chamber and the spring. Instead, it may comprise either the chamber or the spring alone. Further, the accumulation chamber may be replaced by a passage cut in the cylinder and connecting the cylinder chamber 28 and the outlet port 32. In this case, a part of the compressed gas flows through the passage to push the piston.

What we claim is:

1. An electric compressor comprising:

a cylinder having a cylindrical peripheral wall, a top wall blocking one end of the peripheral wall and having a through-hole, a cylinder chamber defined by the cylindrical peripheral wall and top wall, the cylinder having circular inlet and outlet ports opening into the cylinder chamber;

a piston capable of reciprocating in the cylinder chamber and having a first operative face with a first peripheral edge portion inclined at a predetermined angle to the operating direction of the piston and an upper end face facing the top wall;

a rotating member capable of rotating in the cylinder chamber around the central axis thereof, and having an outer peripheral surface substantially equal in diameter to that of the cylinder chamber and capable of opening and closing the inlet and outlet ports, and a second operative face with a second peripheral edge portion inclined at the predetermined angle to the operating direction of the piston and capable of being in sliding contact with the first peripheral edge portion, the second operative face, in conjunction with the first operative face and the peripheral surface of the cylinder chamber, defining a compression chamber capable of communicating with the inlet and outlet ports, and the second peripheral edge portion having a cut face, for controlling the opening and closing of the inlet and outlet ports, which cut face is formed by cutting aslant the lowermost part of the second peripheral edge portion, the inlet port being disposed such that at least the end portion thereof which is located on the rotary member side faces the cut face, and the outlet port being disposed to face the cut face;

pushing means for pushing the piston toward the rotating member to press the first peripheral edge portion against the second peripheral edge portion, the pushing means having a casing with an accumulation chamber, and the cylinder being disposed in the accumulation chamber and the outlet port opening into the accumulation chamber, so that the gas compressed in the compression chamber and discharged into the accumulation chamber is applied to the upper end face of the piston via the through-hole to push the piston toward the rotating member; and driving means for rotating the rotating member, whereby the inlet and outlet ports are opened and closed and the piston is reciprocated so that gas is sucked into the compression chamber through the inlet port, compressed, and discharged through the outlet port.

2. An electric compressor according to claim 1, wherein said piston includes:

a supporting rod extending from the upper end face to penetrate the through-hole of the top wall and guide the piston in reciprocation, and rotation preventing means attached to the supporting rod and engaging the top wall for preventing the piston from rotating.

3. An electric compressor according to claim 2, wherein said rotation preventing means is a key attached to the supporting rod.

4. An electric compressor according to claim 1, wherein said inlet port is formed at a position which is removed from the outlet port by about 90° along the circumferential direction of the cylinder.

5. An electric compressor according to claim 1, wherein said pushing means includes a compression spring disposed between the upper end face of the piston and the top wall of the cylinder.

6. An electric compressor according to claim 1, which further comprises a discharge pipe opening into the accumulation chamber, and a suction pipe penetrating the casing to extend outside the same and connected to the inlet port.

7. An electric compressor according to claim 1, wherein said first peripheral edge portion protrudes from the first operative face toward the rotating member, the second peripheral edge portion is formed by cutting the second operative face, and the vertical sections of the faces of the first and second peripheral edge portions taken along the central axes of the piston and the rotating member are substantially horizontal so that the first and second peripheral edge portions can be in surface contact with each other.

8. An electric compressor according to claim 1, wherein said casing includes a motor chamber and a partition wall dividing the motor chamber from the accumulation chamber, the cylinder being attached to the partition wall, and the rotating member having a lower end face located substantially flush with the partition wall to block the other end of the cylinder.

9. An electric compressor according to claim 8, wherein said driving means includes a motor disposed in the motor chamber, the motor having a rotating shaft attached to the rotating member at one end and located coaxial with the cylinder chamber.

10. An electric compressor according to claim 9, wherein said driving means includes a bearing attached to the partition wall to support the rotating shaft.

11. An electric compressor according to claim 10, which further comprises lubricating means for lubricating the rotating shaft, the piston, and the rotating member.

12. An electric compressor according to claim 11, wherein said lubricating means includes lubricating oil stored in the motor chamber, the other end portion of the rotating shaft being located in the lubricating oil, a guide hole having one end opening to the other end of the rotating shaft and the other end opening to the outer peripheral surface of the one end portion of the rotating shaft to guide the lubricating oil, a first guide groove formed on the outer peripheral surface of the one end portion of the rotating shaft and communicating with the guide hole, a gain portion formed in the bearing and communicating with the first guide groove, and a second guide groove formed in the peripheral wall of the cylinder and communicating with the cylinder chamber.

* * * * *